US012196432B2

(12) United States Patent
Petele et al.

(10) Patent No.: US 12,196,432 B2
(45) Date of Patent: Jan. 14, 2025

(54) INDOOR UNIT OF A HEAT PUMP

(71) Applicants: DAIKIN INDUSTRIES, LTD., Osaka (JP); DAIKIN EUROPE N.V., Ostend (BE)

(72) Inventors: Jan Petele, Plzen (CZ); Josef Cesky, Plzen (CZ)

(73) Assignees: DAIKIN INDUSTRIES, LTD., Osaka (JP); DAIKIN EUROPE N.V., Ostend (BE)

( * ) Notice: Subject to any disclaimer, the term of this patent is extended or adjusted under 35 U.S.C. 154(b) by 25 days.

(21) Appl. No.: 18/009,785

(22) PCT Filed: Sep. 27, 2021

(86) PCT No.: PCT/JP2021/035295
§ 371 (c)(1),
(2) Date: Dec. 12, 2022

(87) PCT Pub. No.: WO2022/065472
PCT Pub. Date: Mar. 31, 2022

(65) Prior Publication Data

US 2024/0035675 A1 Feb. 1, 2024

(30) Foreign Application Priority Data

Sep. 25, 2020 (EP) ..... 20198377

(51) Int. Cl.
*F24F 1/0057* (2019.01)
*F24F 11/36* (2018.01)
(Continued)

(52) U.S. Cl.
CPC ..... *F24F 1/0057* (2019.02); *F24F 11/36* (2018.01); *F24F 11/38* (2018.01); *F24F 11/89* (2018.01)

(58) Field of Classification Search
CPC ..... F24F 11/36; F24F 11/38; F24F 11/89
See application file for complete search history.

(56) References Cited

U.S. PATENT DOCUMENTS

2009/0205352 A1* 8/2009 Choi ..... F24F 1/0067 62/426
2017/0198936 A1* 7/2017 Yamaguchi ..... F24F 11/74
(Continued)

FOREIGN PATENT DOCUMENTS

JP 09274003 A * 10/1997
JP 2013-64524 A 4/2013
(Continued)

OTHER PUBLICATIONS

Extended European Search Report, issued in Priority Application No. 20198377.2, dated Mar. 3, 2021.
(Continued)

*Primary Examiner* — Nelson J Nieves
(74) *Attorney, Agent, or Firm* — Birch, Stewart, Kolasch & Birch, LLP

(57) ABSTRACT

An indoor unit of a heat pump includes a housing having a back to be mounted on a wall and a front opposite to the back, a heat exchanger accommodated in the housing, a piping connection section fluidly connected to the heat exchanger at one side of the heat exchanger and connecting the heat exchanger to a refrigerant circuit of the heat pump, a fan for inducing air flow through the heat exchanger, heat being exchanged between refrigerant flowing through the heat exchanger and air flow, and a refrigerant leakage detection sensor detecting refrigerant leakage in the indoor unit, and being accommodated in the housing. The refrigerant leakage detection sensor is positioned, in a front view of the indoor unit, beside the heat exchanger and in front of
(Continued)

the piping connection section and, in a side view, between the front of the housing and the piping connection section.

20 Claims, 10 Drawing Sheets

(51) Int. Cl.
*F24F 11/38* (2018.01)
*F24F 11/89* (2018.01)

(56) References Cited

U.S. PATENT DOCUMENTS

| | | | | |
|---|---|---|---|---|
| 2017/0314805 | A1* | 11/2017 | Ikawa | F25B 49/02 |
| 2017/0336092 | A1* | 11/2017 | Ikawa | F24F 11/36 |
| 2018/0283718 | A1* | 10/2018 | Honda | F25B 49/005 |
| 2018/0313591 | A1* | 11/2018 | Obara | F24F 13/20 |
| 2021/0018200 | A1* | 1/2021 | Watanabe | F24F 11/62 |
| 2021/0318011 | A1* | 10/2021 | Shaffer | F24F 11/36 |

FOREIGN PATENT DOCUMENTS

| | | | |
|---|---|---|---|
| JP | 2016-70568 | A | 5/2016 |
| JP | 2016-90109 | A | 5/2016 |
| JP | 2016-176648 | A | 10/2016 |
| WO | WO 2017/168834 | A1 | 10/2017 |
| WO | WO 2019/138529 | A1 | 7/2019 |

OTHER PUBLICATIONS

International Search Report, issued in PCT/JP2021/035295, dated Dec. 22, 2021.
European Communication pursuant to Article 94(3) EPC for European Application No. 20198377.2, dated Jan. 30, 2023.
International Preliminary Report on Patentability and Written Opinion of the International Searching Authority for International Application No. PCT/JP2021/035295, dated Apr. 6, 2023.

* cited by examiner

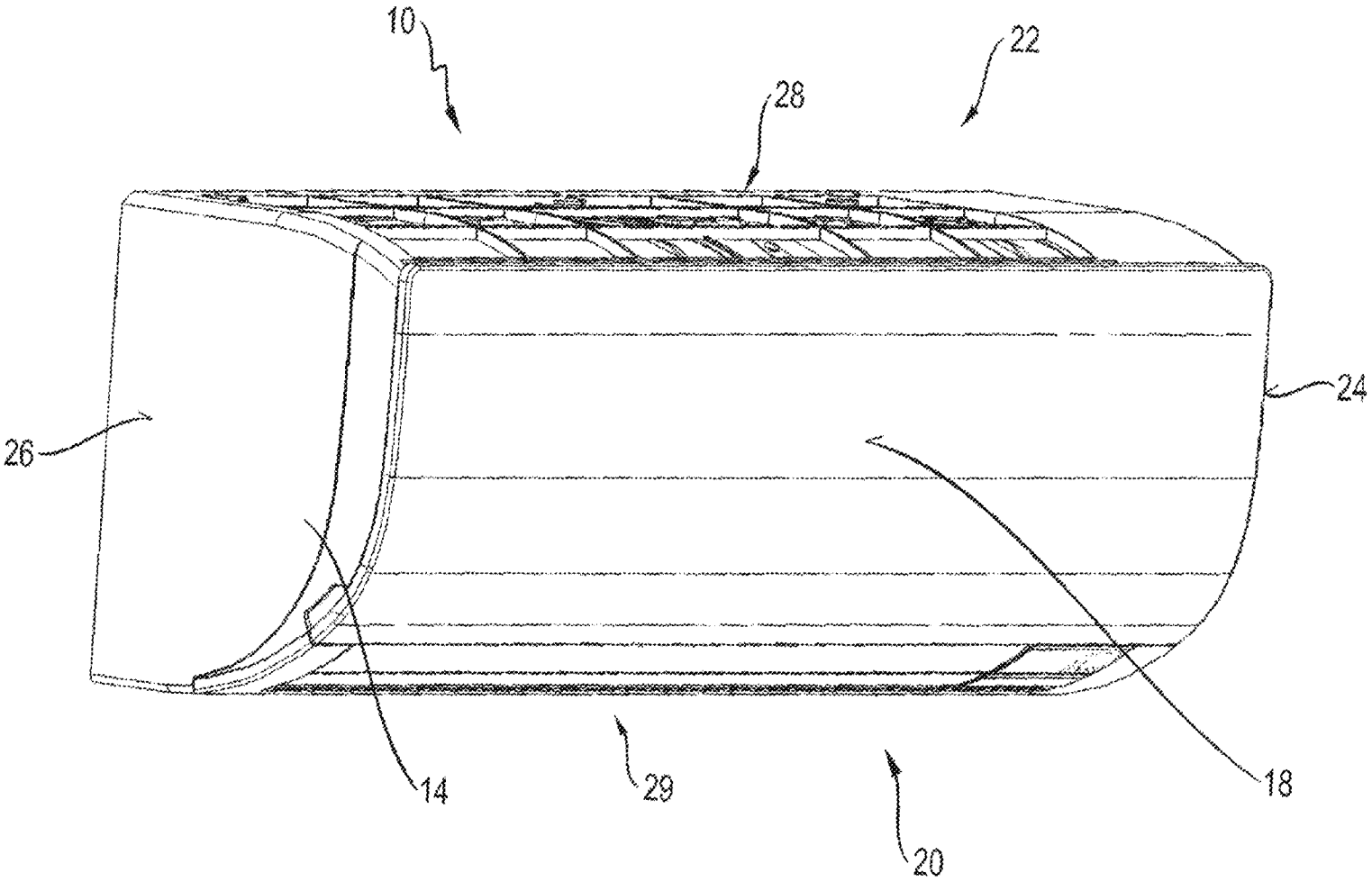
[Fig. 1]

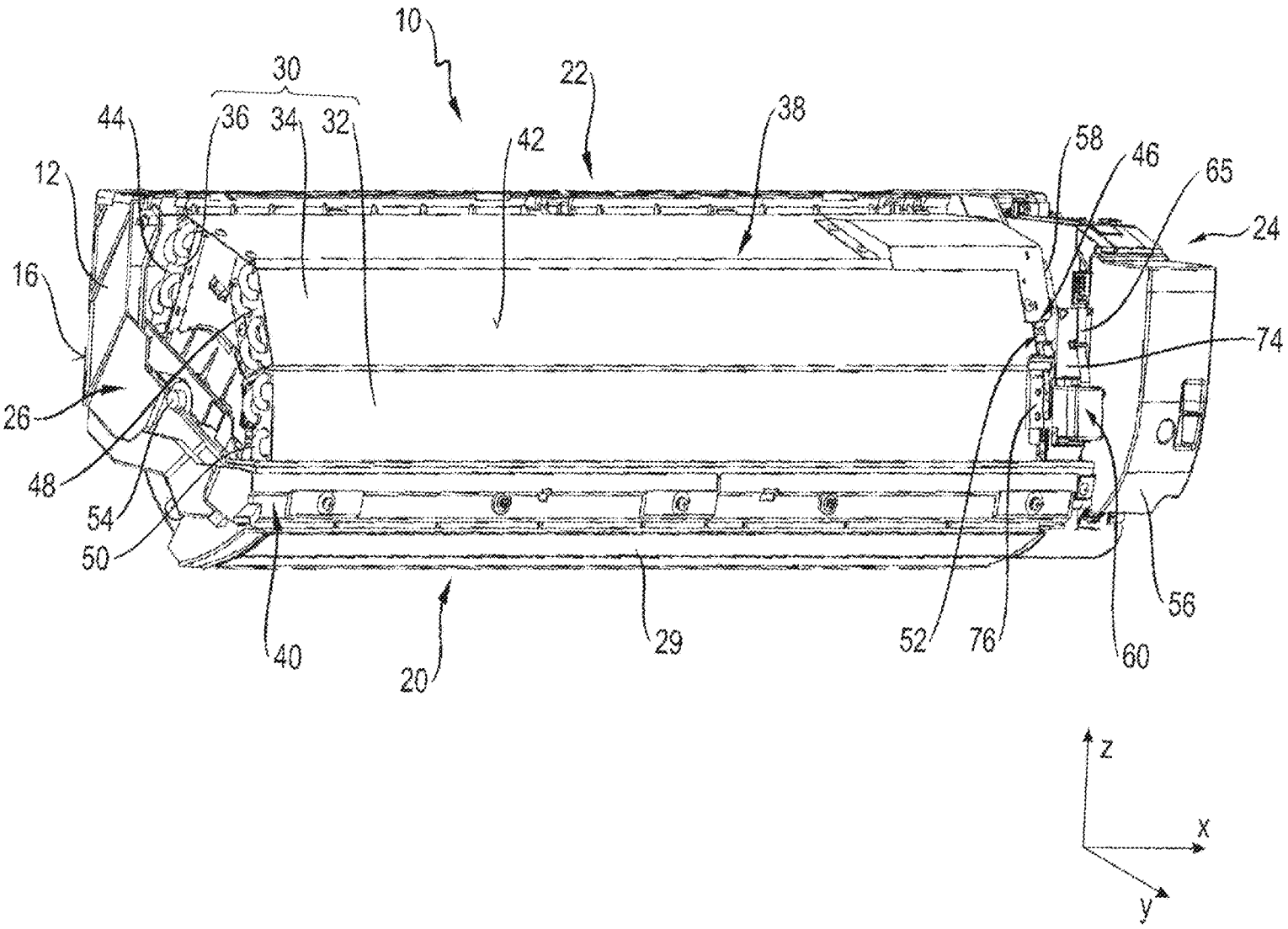
[Fig. 2A]

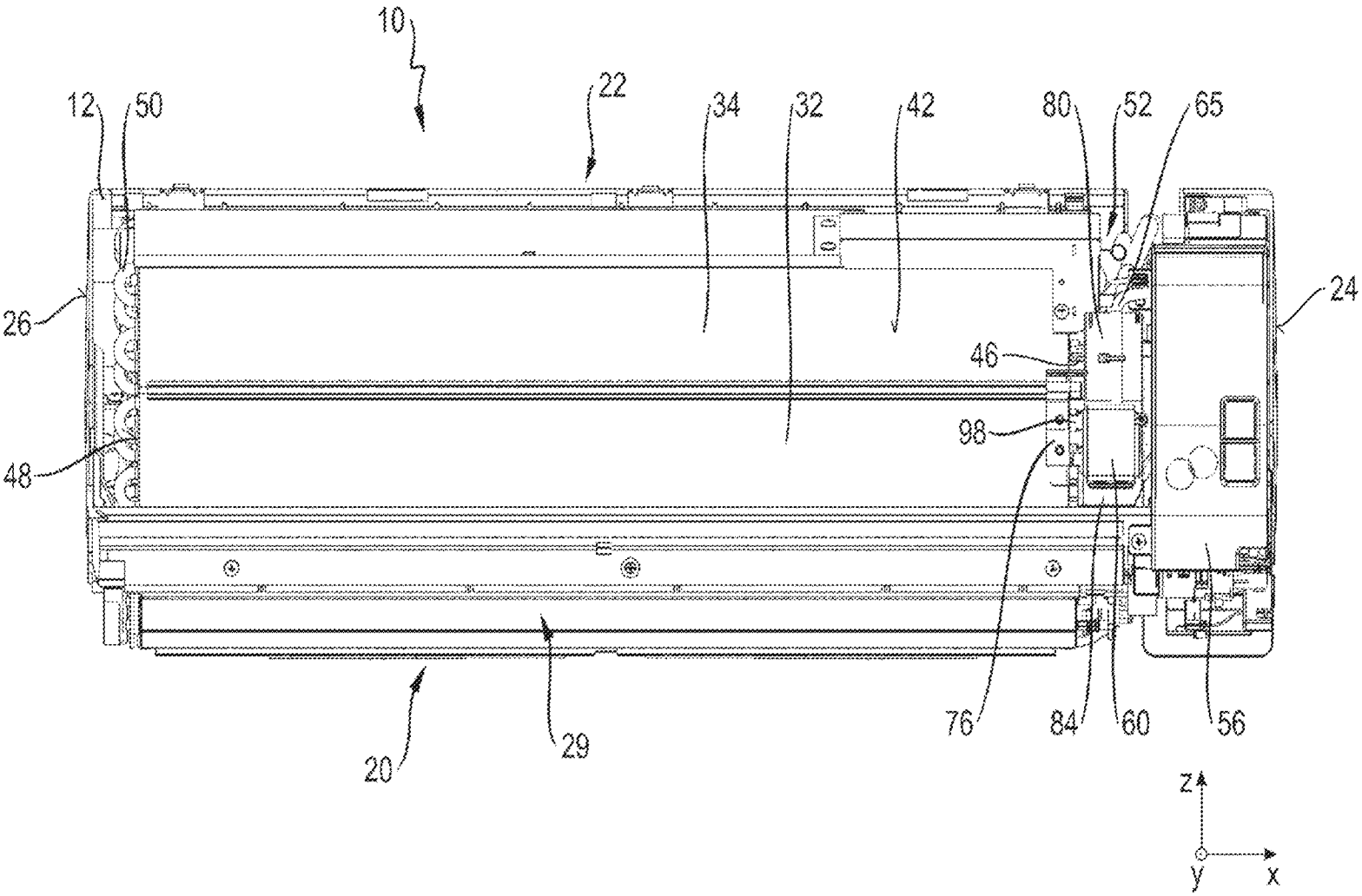
[Fig. 2B]

[Fig. 3]
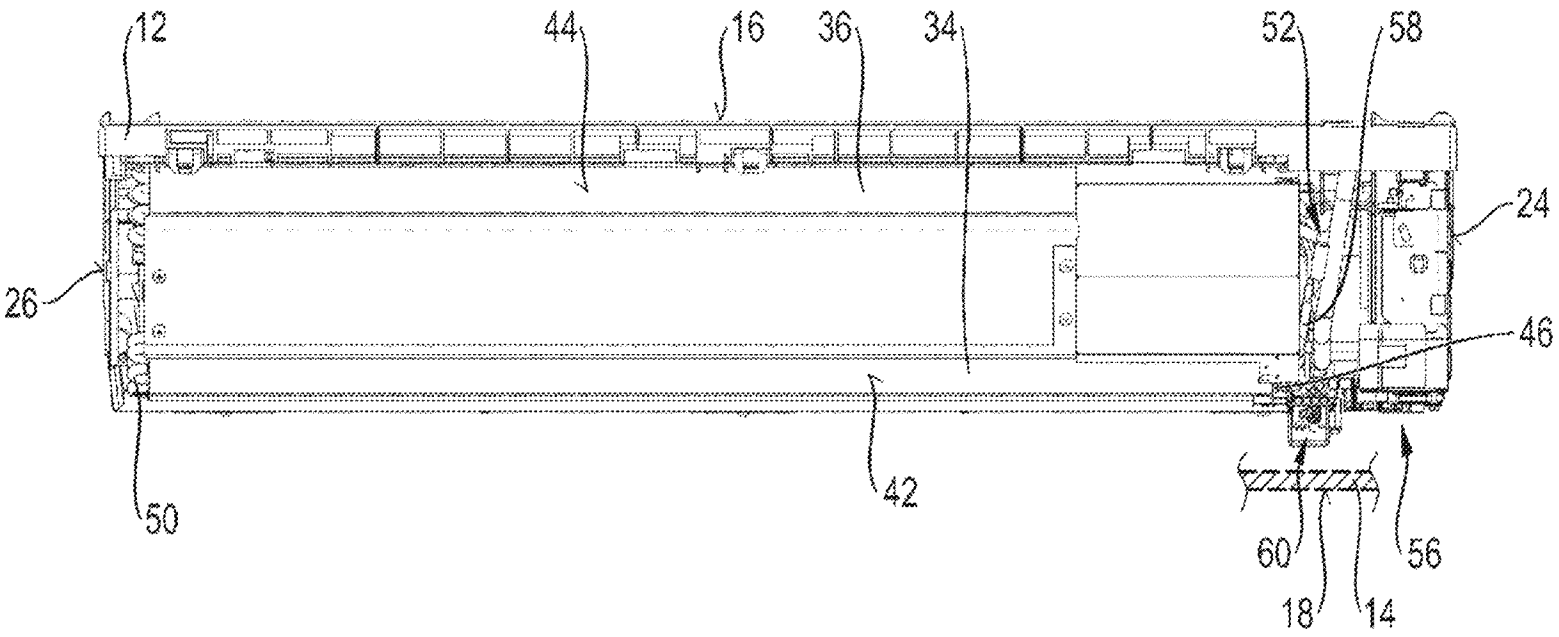

[Fig. 4]
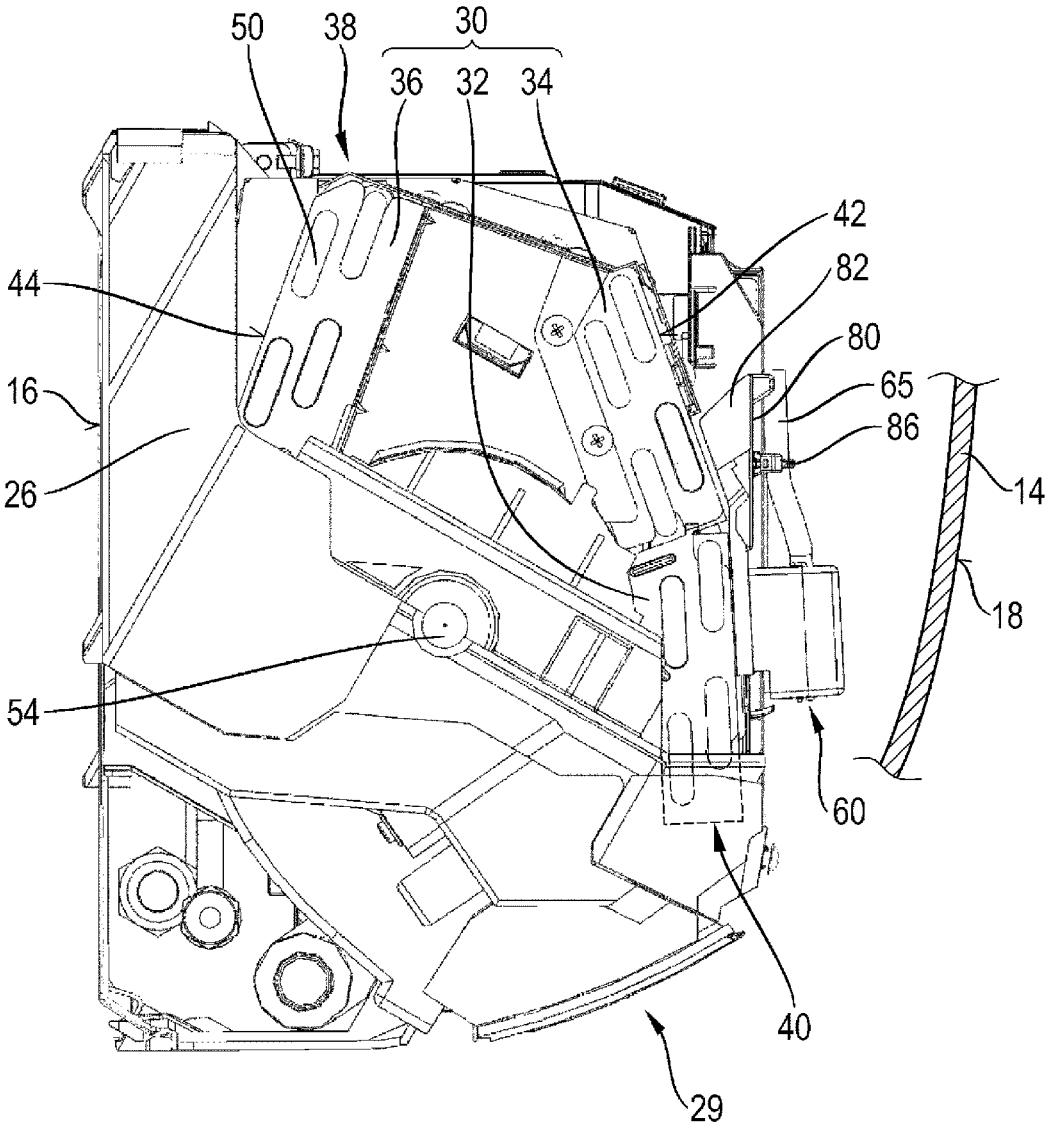

[Fig. 5]
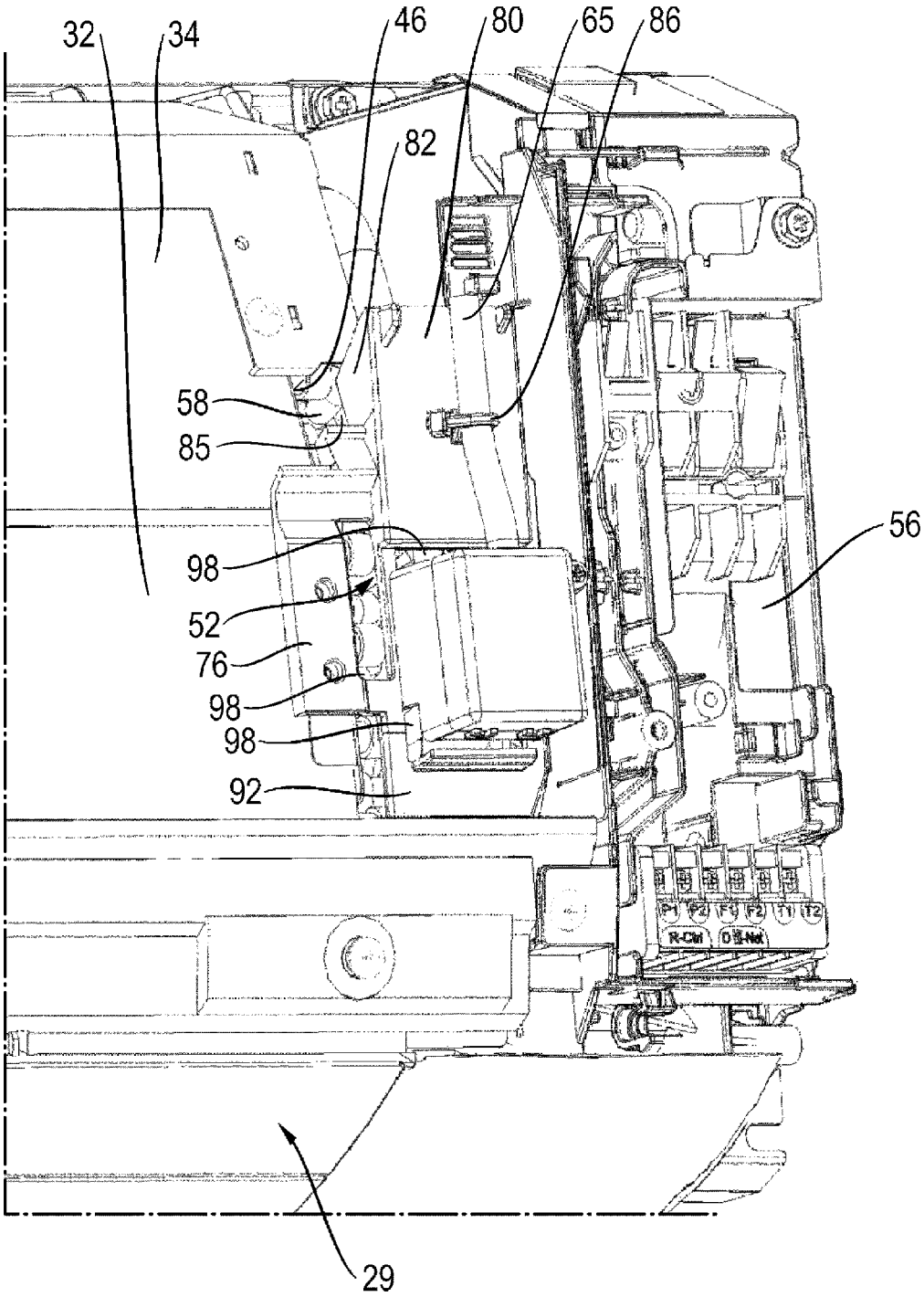

[Fig. 6]
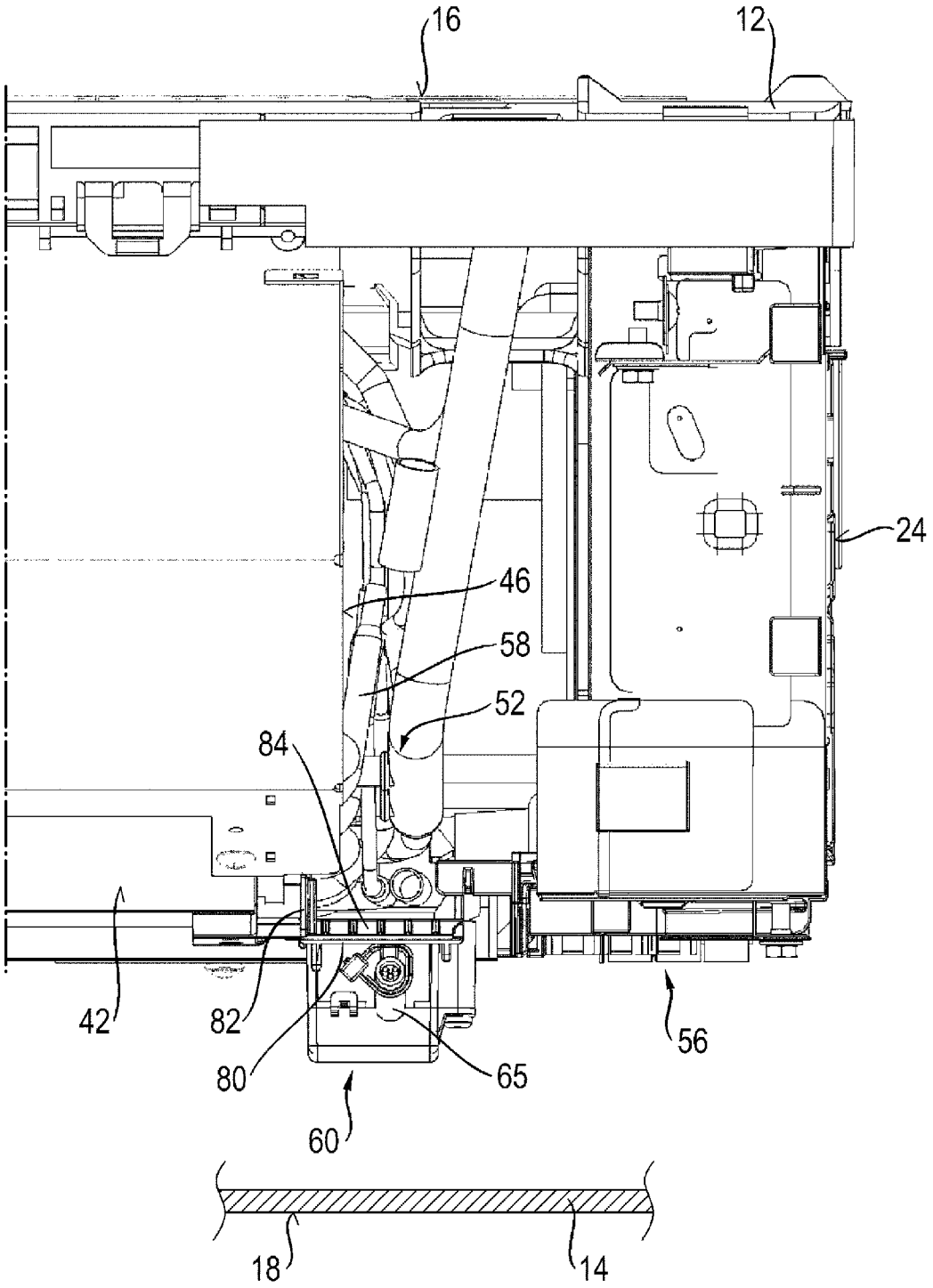

[Fig. 7]
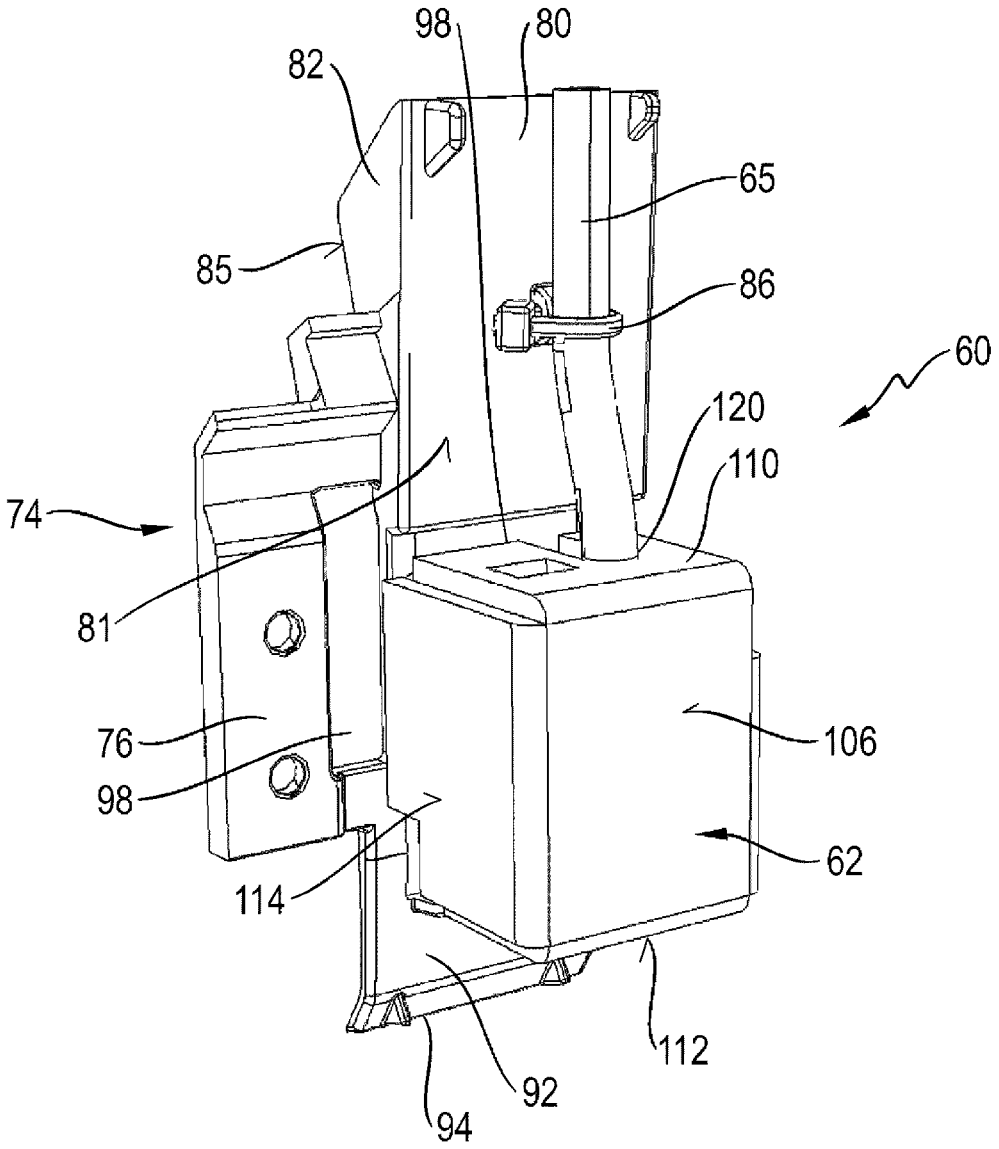

[Fig. 8]
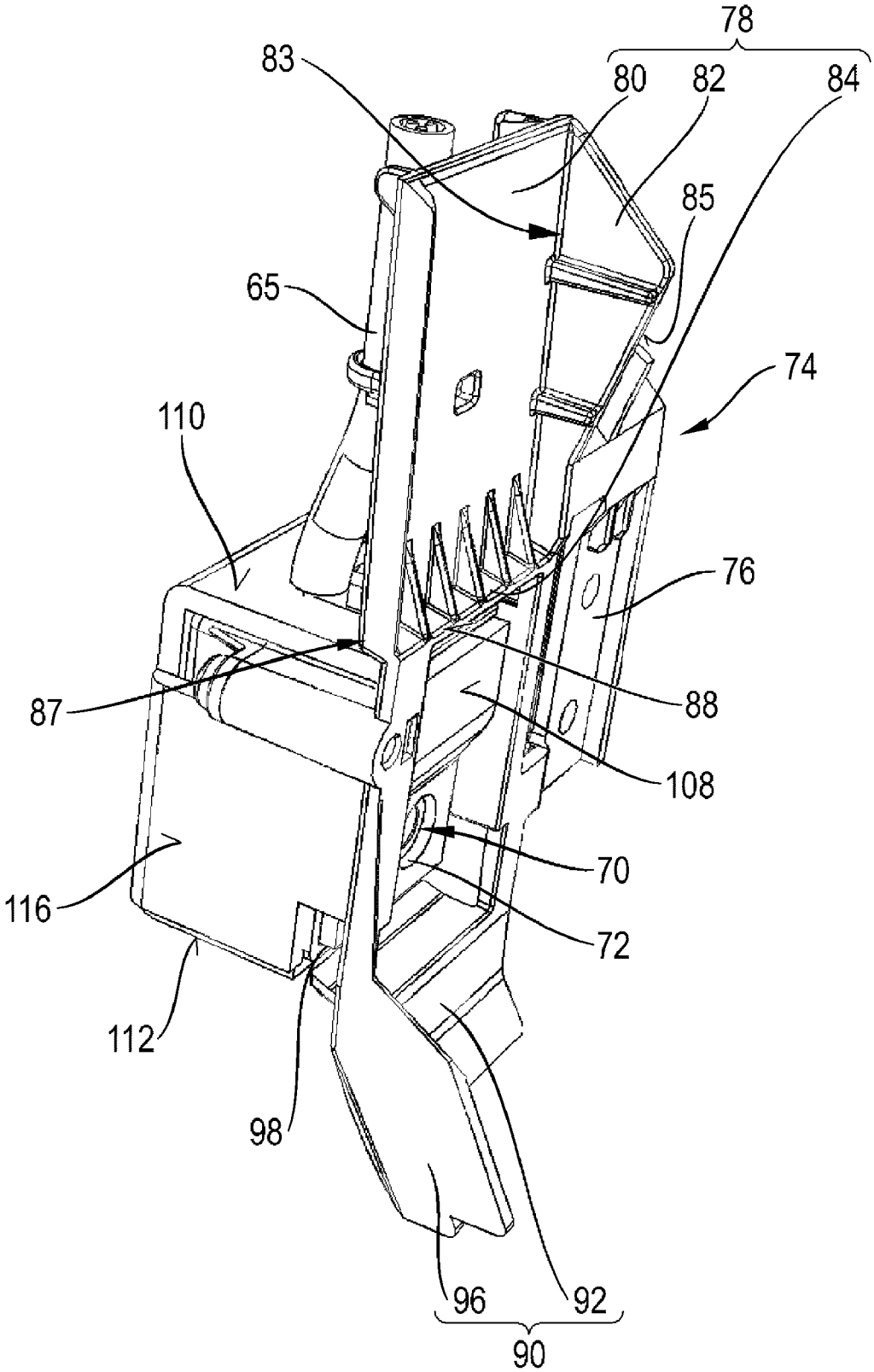

[Fig. 9]
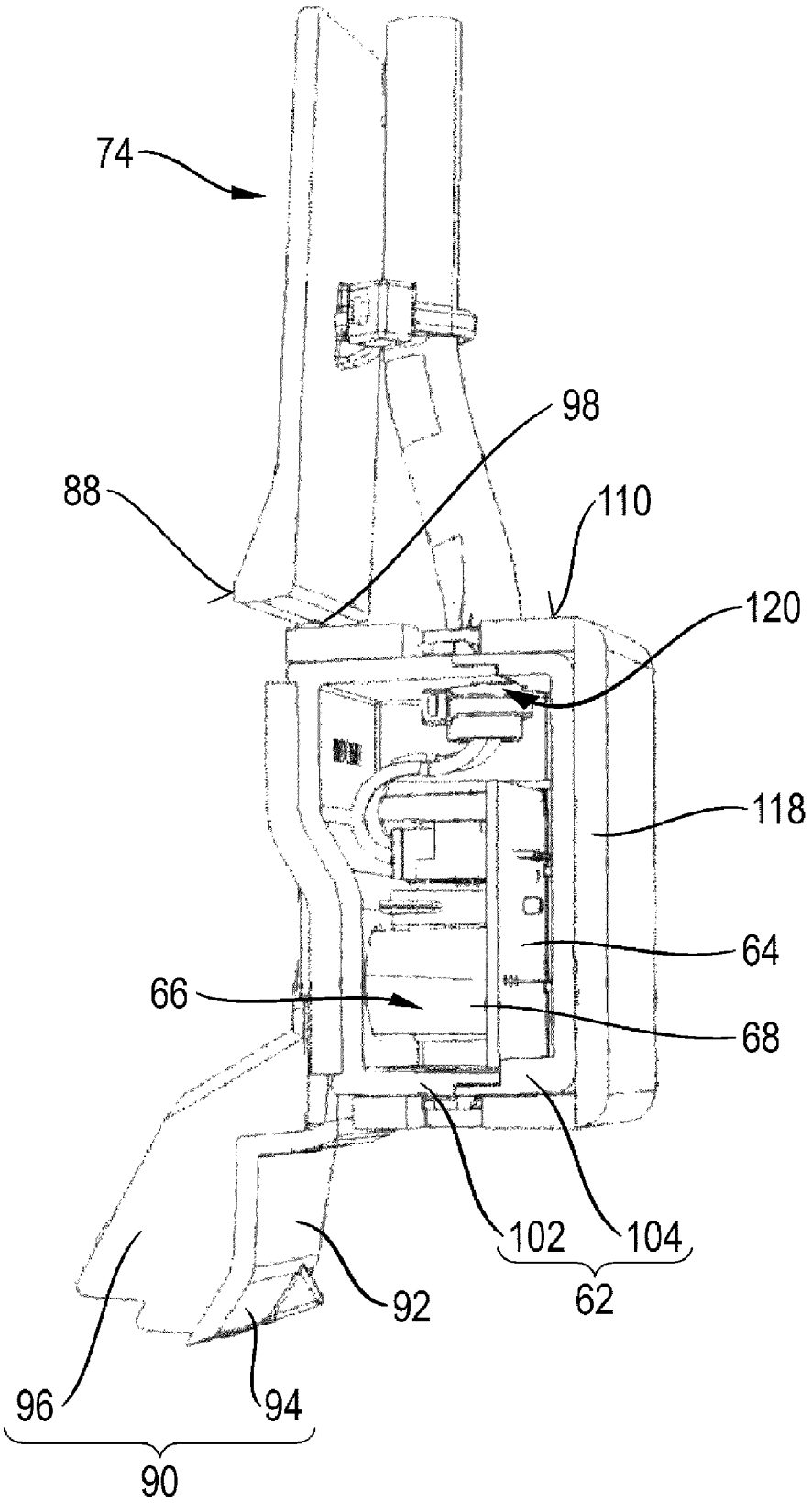

INDOOR UNIT OF A HEAT PUMP

TECHNICAL FIELD

The present disclosure relates to an indoor unit, particularly a wall-mounted indoor unit, of a heat pump, the indoor unit comprising a refrigerant leakage detection sensor.

BACKGROUND ART

Such a wall-mounted indoor unit is e.g. disclosed in WO 2019/138529 A1. The disclosed indoor unit comprises a heat exchanger accommodated in a housing and a piping connection section fluidly connected to the heat exchanger at one side of the heat exchanger and configured to connect the heat exchanger to the refrigerant circuit of the heat pump. Further disclosed is a refrigerant leakage detection sensor accommodated in the housing for detecting a refrigerant leakage in the indoor unit. In WO 2019/138529 A1, the refrigerant leakage detection sensor is attached to the refrigerant pipes of the piping connection section to enable immediate detection of a refrigerant leakage.

During operation, the temperature of the surface of the refrigerant pipes of the piping connection section may significantly vary, e.g. between −30° Celsius and +80° Celsius. Thus, relatively robust sensors are required which are usually expensive. Additionally, the temperature changes reduce the lifetime of the sensor and have a disadvantageous influence on the accuracy of the sensor.

Even further, if the refrigerant leakage detection sensor is located close or even in contact with the refrigerant pipes of the piping connection section, the sensor itself may have a temperature equal to or lower than the dewpoint, e.g. after a defrosting operation. Thus, condensation water may be generated on the surface of the sensor. Hence, waterproof specifications are required increasing the costs for the sensor.

In addition, one aims at positioning the refrigerant leakage detection sensor to enable a quick detection of a refrigerant leakage no matter where it occurs in the indoor unit. This particularly applies for refrigerants having a higher density than air such as R32.

In view of the aforesaid, it is an object of the present disclosure to provide an indoor unit allowing the use of a relatively inexpensive refrigerant leakage detection sensor still providing good and fast detection accuracy substantial independent of the location of the refrigerant leak within the indoor unit.

SUMMARY OF INVENTION

This object is solved by an indoor unit of a heat pump as defined in claim 1. Further embodiments are defined in the dependent claims.

According to a first aspect, an indoor unit of a heat pump comprising a refrigerant circuit is suggested. In its simplest configuration, the refrigerant circuit may comprise a heat source heat exchanger (e.g. an outdoor heat exchanger) an expansion mechanism (e.g. an expansion valve), a utilization side heat exchanger (e.g. an indoor heat exchanger) and a compressor connected by refrigerant pipes. The refrigerant circuit may be filled with R32 as refrigerant. The indoor unit of the first aspect comprises a housing having a back configured to be mounted on a wall and a front opposite to the back. Additionally, the housing may have a bottom, a top and opposite side walls. A heat exchanger (the indoor or utilization side heat exchanger of the heat pump) is accommodated in the housing. The heat exchanger may comprise several portions including a front portion facing the front of the indoor unit and a rear portion facing the back of the indoor unit. The heat exchanger may have opposite sides, a top end, a bottom end, a front and a back. The heat exchanger is connected to the refrigerant circuit of the heat pump via a piping connection section fluidly connected to the heat exchanger at one side of the heat exchanger. The one side of the heat exchanger may face one of the opposite sides (side walls) of the housing. To put it differently, the piping connection section may be disposed between one side of the heat exchanger and one side (side wall) of the housing. A fan is provided to induce an air flow through the heat exchanger, a fan is provided, wherein heat is to be exchanged between a refrigerant flowing through the heat exchanger and the air flow induced by the fan. Further, the indoor unit comprises a refrigerant leakage detection sensor for detecting a refrigerant leakage in the indoor unit, the refrigerant leakage detection sensor being accommodated in the housing. In this first aspect, the refrigerant leakage detection sensor is positioned, in a front view of the indoor unit, beside (neighboring) the heat exchanger and in front of (facing or ahead of) the piping connection section and, in a side view of the indoor unit, between the front of the housing and the piping connection section. In other words, the refrigerant leakage detection sensor is positioned in a space limited by one side of the heat exchanger, a side (side wall) of the housing, the front of the housing and a front of the refrigerant pipes of the piping connection section. In this context, the front of the refrigerant pipes of the piping connection section is defined as the smallest envelope enclosing the (all) refrigerant pipes of the piping connection section. The front of the housing may be a front cover or be part of the front cover. The back of the housing may be a body or be part of the body.

According to the first aspect, the refrigerant leakage detection sensor is out of contact with the refrigerant pipes of the piping connection section. As a consequence, the refrigerant leakage detection sensor is positioned in an area less prone to significant temperature changes. Hence, a less expensive temperature sensor may be used, yet providing high accuracy and reliable leakage detection. Additionally, the positioning of the refrigerant leakage detection sensor in the first aspect enables reliable detection of a leak substantially independent from the location within the housing of the indoor unit.

According to a second aspect, the refrigerant leakage detection sensor is positioned closer to a bottom end of the heat exchanger than to a top end of the heat exchanger. Preferably, the refrigerant leakage detection sensor is positioned in a lower ⅓ of the housing of the indoor unit.

The configuration of the second aspect enables reliable detection also of refrigerants, such as R32, having a higher density than air, which are likely to accumulate in a bottom region of the indoor unit. Additionally, it also enables faster detection of a refrigerant leak occurring at the opposite side of the heat exchanger, i.e. the side opposite to the side at which the piping connection section is located. Refrigerant leaking from the side will accumulate in a bottom region of the in the unit and spread over the entire bottom region over the time. Eventually, the refrigerant will reach the side at which the piping connection section is located and may then still be detected by that refrigerant leakage detection sensor.

According to a third aspect, the indoor unit further comprises an electric box accommodated in the housing adjacent the piping connection section of the heat exchanger, wherein refrigerant leakage detection sensor is positioned, in a front view of the indoor unit, between the heat exchanger and the electric box, i.e. in a space between the side of the heat exchanger and a facing side of the electric box. The electric box may for example accommodate a controller for controlling the operation of the indoor unit. The controller may electrically communicate with a main controller of the heat pump.

According to the third aspect, the space in which leaking refrigerant may accumulate is limited to the space between the electric box and the side of the heat exchanger facing the electric box. Due to the limited space, the concentration of leaking refrigerant quickly increases, and detection accuracy and speed are enhanced. Additionally, the refrigerant leakage detection sensor is located close to the electric box so that the length of an electric cable for connecting the refrigerant leakage detection sensor to, e.g. the controller contained in the electric box, may be kept short.

According to fourth aspect, the refrigerant leakage detection sensor comprises a sensor casing, a circuit board enclosed by the sensor casing and a gas sensor mounted on the circuit board. The gas sensor has a housing, a refrigerant reception area at an end of the housing allowing gaseous refrigerant to enter the housing and a sensing element in the housing, wherein the housing protrudes through an opening in a side wall of the sensor casing in a direction towards the piping connection section so that the refrigerant reception area is arranged outside the sensor casing.

Due to this configuration a major portion of the gas sensor is located inside the sensor casing, protecting the gas sensor from moisture. Additionally, the heat generated by the gas sensor during operation is almost fully kept inside the sensor casing, leading to a so called "thermal capsule" or "thermal pocket" covering the gas sensor, in particular the circuit board of the gas sensor. Moreover, the "thermal capsule" or "thermal pocket" leads to the advantage that the temperature in the vicinity of the sensor becomes higher, reducing the humidity surrounding the sensor. Yet, as the refrigerant reception area is outside the sensor casing, meaning in direct contact with the surrounding air, detection sensitivity and detection reliability can be enhanced.

In this context, the term "refrigerant reception area" concerning the "gas sensor" defines in the present disclosure that the housing of the gas sensor, in particular the end or top of the housing is provided with an area or surface that allows refrigerant, in particular gaseous refrigerant, to penetrate the reception area and thereby enter the housing of the gas sensor. In this way the refrigerant reception area makes it possible that, on one hand, gaseous refrigerant can enter the housing and thereby reach the sensing element, preferably arranged inside the housing, and, on the other hand, the refrigerant reception area prevents moisture and water, in particular condensed water, to enter the housing. In other words, the refrigerant reception area, which is preferably a membrane, is impermeable to liquids like moisture and water but permeable to air. Alternatively, the refrigerant reception area could include an upper layer made of a silica filter and a lower layer made of active charcoal.

Furthermore, the term "sensing element" defines in the present disclosure any means that is able to detect a physical parameter like temperature, pressure or humidity or resistance, particularly the existence of a gaseous refrigerant (gas sensor).

According to a fifth aspect, the sensor casing is mounted in the indoor unit via a support structure. Besides supporting and mounting the sensor casing in the indoor unit, the support structure is configured to further limit the space around the refrigerant leakage detection sensor, particularly the refrigerant reception area, towards the front of the indoor unit. According to the fifth aspect, the support structure may comprise a first shielding structure having a first shield extending upwardly from the side wall of the sensor casing having the opening, and covering, in a front view, refrigerant pipes extending from a side of the heat exchanger.

As a result, one may avoid leaking refrigerant to bypass the refrigerant leakage detection sensor and the concentration of leaking refrigerant around the refrigerant leakage detection sensor, particularly the refrigerant reception area, can be increased leading to a more accurate and faster detection. To put it differently, the first shield closes the space defined between the side of the heat exchanger and the side (side wall) of the housing/side of the electric box relative to the front. Additionally the first shield allows to shield water drops (condensed water from the refrigerant pipes) spread by the air flow induced by the fan from the sensor casing.

According to a sixth aspect, the refrigerant leakage detection sensor comprises an electric cable connected to the circuit board through an opening in a top wall of the sensor casing, the electric cable extending from the top wall of the sensor casing along a front side of the first shield to an/the electric box accommodated in the housing so that the electric cable is shielded relative to the refrigerant pipes by the first shield.

Hence, the first shield prevents water drops (condensed water from the refrigerant pipes) spread by the air flow induced by the fan from reaching the electric cable. Thus, it is less likely that water drops flow along the electric cable with the risk of entering the sensor casing through the opening in the top wall.

According to a seventh aspect the first shielding structure has a second shield extending from a side edge of the first shield towards a front surface of the heat exchanger.

The second shield may extend/prolong/lengthen the side surface of the heat exchanger at the side of the heat exchanger to limit the space at which leaking refrigerant may accumulate. To put it differently, the second shield cooperates with the heat exchanger for limiting the space in which the refrigerant leakage detection sensor is positioned. Hence, the concentration of leaking refrigerant can be increased, and accuracy and speed of detection may be improved.

According to an eighth aspect, the second shield has a slanted edge facing the front surface of the heat exchanger and corresponding to the shape of the front surface of the heat exchanger.

The first shield substantially extends vertically. As the front of the heat exchanger may be slanted relative to the vertical, the surface of the first shield facing the front of the heat exchanger may in a top portion of the first shield be distanced to the front of the heat exchanger forming a gap between the surface of the first shield and the front of the heat exchanger. To close the gap, the second shield is provided and has an edge facing the front surface of the heat exchanger which is slanted relative to the vertical as well. Hence, any leaking refrigerant is prevented from escaping through the gap enhancing the detection accuracy.

According to a ninth aspect, the first shielding structure has a third shield extending from a lower end of the first shield towards the piping connection section and beyond the refrigerant reception area so that the end of the third shield facing the piping connection section is located closer to the piping connection section than the refrigerant reception area. To put it differently, the third shield forms a shoulder, similar to a roof, protecting the refrigerant reception area, wherein the front edge of the third shield is located in a distance to the refrigerant reception area.

Accordingly, any water drops caught by the first shield and flowing along the first shield towards the refrigerant reception area are prevented from dropping on the gas sensor, particularly its refrigerant reception area.

According to a tenth aspect, the support structure has a second shielding structure having a fourth shield extending downwardly relative to the side wall of the sensor casing having the opening.

Accordingly and if a leak occurs in a relatively low position in the space between the side of the heat exchanger and the side wall of the housing/side of the electric box, the leaking refrigerant is prevented from escaping below the refrigerant leakage detection sensor. Thus, reliable detection of a leak in this area is ensured.

According to a tenth aspect, the fourth shield has a bottom portion slanted towards the pipe connection section and corresponding in a side view to the shape of the front surface of the heat exchanger.

Due to this configuration, the space between the side of the heat exchanger, the front of the piping connection section, the side (side wall) of the housing/side of the electric box is limited also in a lower portion increasing the detection accuracy and speed.

According to a twelfth aspect, the support structure has a fifth shield extending from the fourth shield towards the piping connection section.

As the second shield, the fifth shield enables to close the gap between the fourth shield and the side (side wall) of the housing/side of the electric box preventing leaking refrigerant from escaping through the gap.

According to a thirteenth aspect, the support structure has at least one through hole for allowing gaseous refrigerant to pass from a side of the support structure facing the front of the indoor unit through the support structure and to the refrigerant reception area of the refrigerant leakage detection sensor.

As the support structure and particularly the first and/or second shielding structure close the space between the side of the heat exchanger, the front of the piping connection section and the side (side wall) of the housing/side of the electric box relative to the front, refrigerant potentially leaking at the opposite side of the heat exchanger or at the front of the heat exchanger may not easily reach the refrigerant leakage detection sensor, particularly the refrigerant reception area of the gas sensor. In order to also allow quick and reliable detection of those leaks the through holes in the support structure allow gaseous refrigerant to enter said space and, therefore, reach the refrigerant reception area.

According to a fourteenth aspect, the circuit board comprises an evaluation unit configured to evaluate a signal received from sensing element, to conclude on refrigerant leakage based on the received signal and to output a (digital) leakage signal to a controller of the indoor unit.

Due to this digital communication of the leakage signal, a better resistance to electromagnetic noises is achieved.

According to a fifteenth aspect, the housing comprises a body including the back and a front cover including the front, the front cover being removable, and the refrigerant leakage detection sensor is accessible by removing the front cover.

Because of this configuration easy maintenance of the refrigerant leakage detection sensor is realized.

BRIEF DESCRIPTION OF DRAWINGS

FIG. 1 shows a front perspective of an indoor unit according to an embodiment.

FIG. 2A shows a front perspective of the indoor unit in FIG. 1 with the front cover being removed.

FIG. 2B shows a front view of the indoor unit in FIG. 1 with the front cover being removed.

FIG. 3 shows a top view of the indoor unit in FIG. 2B with part of the electric box being removed.

FIG. 4 shows a left side view of the indoor unit in FIG. 2B.

FIG. 5 shows an enlarged portion of the front perspective of the indoor unit in FIG. 2A with part of the electric box being removed.

FIG. 6 shows an enlarged portion of the top view of the indoor unit in FIG. 3.

FIG. 7 shows the refrigerant leakage detection sensor in isolation in a front perspective.

FIG. 8 shows the refrigerant leakage detection sensor in FIG. 7 in a rear perspective.

FIG. 9 shows the refrigerant leakage detection sensor in a cross-sectional view.

DESCRIPTION OF EMBODIMENTS

Preferred embodiments of an indoor unit according to the present disclosure are described in the corresponding figures. Modifications of features can be combined to form further embodiments. The indoor unit described below is to be understood as exemplary and not limiting. Features of the embodiment described below can also be used to further characterize the indoor unit defined in the claims.

As shown in FIGS. 1 to 6, the indoor unit comprises a housing 10. In the present embodiment, the housing 10 comprises a body 12 and a front cover 14. The body 12 comprises at least a back 16 and the front cover 14 comprises at least a front 18. The front cover 14 is only shown in FIG. 1. A partial cross-sectional view of the front 18 of the front cover 14 is shown in FIGS. 3, 4 and 6. The housing 10, thus, comprises the back 16 for mounting the housing 10, particularly the body 12, to a wall (not shown). The front 18 of the housing 10 is located opposite to the back 16. The housing further comprises a bottom 20 and a top 22 as well as opposite sides 24 (first side 24) and 26 (second side 26) which may partially be formed by the front cover 14 and/or the body 12.

A heat exchanger 30 being part of a refrigerant circuit of the heat pump is accommodated in the housing 10. The heat exchanger 30 may be formed from separate portions respectively connected to each other. In the present embodiment, the heat exchanger 30 comprises two front portions 32 (first front portion) and 34 (second front portion) and a rear portion 36. Yet, the heat exchanger 30 may comprise less or more portions depending on the configuration of the indoor unit.

The heat exchanger 30 comprises a top end 38 defined by the uppermost point of the heat exchanger 30 or respectively the portions of the heat exchanger 30 and a bottom end 40 defined by the lowermost point of the heat exchanger 30 or respectively the portions of the heat exchanger 30. The heat exchanger 30 further has a front surface 42, in the present embodiment formed by front surfaces of the first and second front portions 32 and 34 directed towards the front 18 of the housing 10. The heat exchanger further has a back surface 44 formed by the back surface of the rear portion 36 facing the back 16 of the housing 10. Additionally, the heat exchanger 30 comprises opposite sides or side surfaces, the first side 46 and the second side 48.

The heat exchanger 30 may further comprise a plurality of refrigerant pipes passing through a plurality of fins arranged in a row from the first side 46 to the second side 48. Two refrigerant pipes are respectively fluidly connected to each other by U-bend portions 50 formed at the first side 46 and second side 48 of the heat exchanger 30. In order to fluidly connect the refrigerant pipes to the refrigerant circuit of the heat pump, a piping connection section 52 is located at the first side 46 of the heat exchanger 30. The piping connection section 52 may for example comprise a header respectively connected to the refrigerant pipes 58 of the heat exchanger 30. The piping connection section 52 may further comprise an indoor expansion valve of the refrigerant circuit, a muffler or the like.

Moreover, a fan (merely the axis of rotation 54 is visible in FIG. 4) is accommodated in the housing 10 inducing an air flow through the heat exchanger 30. In particular, an air flow is induced entering the housing 10 through a suction area 28, passing the heat exchanger 34 and being discharged via the discharge area 29. During operation, heat is exchanged between the refrigerant, such as R32, flowing through the refrigerant pipes of the heat exchanger 30 and the air flow induced by the fan 54 and passing the heat exchanger 30.

Moreover, an electric box 56 is accommodated in the housing 10. The electric box 56 may comprise a controller for controlling the operation of the indoor unit. The controller may electrically be communicated with the main control of the heat pump. In the shown embodiment, the electric box 56 is located between the first side 46 of the heat exchanger 30 and the first side 24 of the housing 10.

The shown indoor unit further comprises a refrigerant leakage detection sensor 60 accommodated in the housing 10. The purpose of the refrigerant leakage detection sensor is to detect a refrigerant leakage in the indoor unit, particularly in the housing 10 of the indoor unit. The refrigerant leakage detection sensor 60 is described in more detail with reference to FIGS. 7 to 9.

The refrigerant leakage detection sensor 60 comprises a sensor casing 62.

The sensor casing 62 comprises a casing body 102 and a casing lid 104 removably attached to the casing body 102 (see FIG. 9). The sensor casing 62 has opposite side walls 106 and 108 (which may also be referred to as front wall 106 and back wall 108), a top wall 110, a bottom wall 112 as well as opposite side walls 114 and 116. The sensor casing 62 is surrounded by a thermal insulation 118.

A circuit board 64 (see FIG. 9) is enclosed by the sensor casing 62. A gas sensor 66 is mounted on the circuit board. The gas sensor 66 has a sensor housing 68 (see FIG. 9) and a refrigerant reception area 70 which is located at an end of the sensor housing 68. The refrigerant reception area 70 enables that gaseous refrigerant enters the sensor housing 68 and thereby reaches a (not shown) sensing element, which is located inside the sensor housing 68.

The gas sensor 66, in particular the sensor housing 68 protrudes into or through an opening 72 arranged in the (vertical) side wall (back wall) 108 of the sensor casing 62, particularly the casing body 102. The refrigerant reception area 70 is located outside the sensor casing 62 or in the opening 72 so that gaseous refrigerant may reach the refrigerant reception area 70 and enter the sensor housing 68. In this context, the sensor housing 68 protrudes (extends) in a direction towards the piping connection section (i.e. towards the back of the indoor unit). On the other hand, the (not shown) sensing element may be located inside the sensor housing 68.

An electric cable 65 is connected to the circuit board 64. The electric cable 65 extends through an opening 120 in the top wall 110 of the sensor casing 62, particularly the casing body 102. The electric cable 64 is led to the electric box 56 and connected to the (not shown) controller.

The circuit board 64 comprises an evaluation unit configured to evaluate a signal received from sensing element, to conclude on refrigerant leakage based on the received signal and to output a digital leakage signal to the controller of the indoor unit.

In the shown embodiment, a support structure 74 is used for mounting the refrigerant leakage detection sensor 60. The support structure may be integrally formed with the sensor casing 62. Alternatively, the sensor casing 62 may be separately formed and attached to the support structure 74. In the shown embodiment, the casing body 102 of the sensor casing 62 and the support structure 74 are integrally formed as a one piece.

The support structure 74 may be removably mounted to the front surface 42 of the heat exchanger 30 by e.g. a mounting portion 76.

The support structure 74 further comprises a first shielding structure 78 and a second shielding structure 90.

The first shielding structure 78 comprises a first shield 80, a second shield 82 and a third shield 84.

The first shield 80 extends upwardly from the back wall 108 of the sensor casing 62. In an embodiment, the first shield 80 may substantially extend vertically. The first shield 80 may be configured to cover, in a front view, refrigerant pipes 58 of the piping connection section 52 extending from a side 46 of the heat exchanger 30.

The electric cable 65 extending from the top wall 110 of the sensor casing 62 extends along a front side/surface 81 of the first shield 80. The front side/surface 81 of the first shield 80 faces away from the piping connection section 52 and towards the front 18 of the housing 10. The electric cable 65 may be attached to the front side/surface 81 of the first shield 80 by e.g. a cable clip 86. Thus, the electric cable 65 is shielded relative to the refrigerant pipes 58/piping connection section 52 by the first shield 80.

The second shield 82 extends from a side edge 83 of the first shield 80. The side edge 83 is located on side facing the first side 46 of the heat exchanger 30. The second shield 82 protrudes substantially perpendicular from the first shield 80 towards the front surface 42 of the heat exchanger 30. The lower edge 85 facing the front surface 42 of the heat exchanger 30 is shaped (slanted) in correspondence to the shape of the front surface 42 of the heat exchanger 30. In the shown embodiment, the second shield 82 has a triangular shape with one leg corresponding to the slanted edge 85 of the second shield 82.

The third shield 84 extending from a lower end 87 of the first shield 80 towards the piping connection section 52 and beyond the refrigerant reception area 70 or even the side wall 108 of the sensor casing 62. Hence, the end or free edge 88 of the third shield 84 facing the piping connection section 52 is located closer to the piping connection section 52 than the refrigerant reception area 70 or even the side wall 108 of the sensor casing 62.

The second shielding structure 90 has a fourth shield 92 and a fifth shield 96.

The fourth shield 92 extends downwardly relative to the side wall 108 of the sensor casing 62 having the opening 72. In the shown embodiment, the fourth shield 92 extends substantially vertically downward.

The fourth shield 92 has a bottom portion 94 slanted towards the pipe connection section 52 and corresponding in a side view to the shape of the front surface 42 of the heat exchanger 30.

The fifth shield 96 extends from the fourth shield 92 towards the piping connection section 52. In the embodiment, the fifth shield 96 protrudes substantially perpendicular from the fourth shield 94 towards the back 16.

The support structure 74 further has through holes 98 for allowing gaseous refrigerant to pass from a side of the support structure 74 facing the front 18 of the housing 10/of the indoor unit through the support structure 74 and to the refrigerant reception area 70 of the refrigerant leakage detection sensor 60.

Refrigerant leakage is most likely to occur at brazing points of refrigerant pipes or at connection fittings. Hence, the piping connection section 52 is susceptible for refrigerant leakage. For this purpose, the refrigerant leakage detection sensor 60 is positioned adjacent the piping connection section 52. Yet, rather than attaching the refrigerant leakage detection sensor 60 to the refrigerant pipes 58 of the piping connection section 52, the refrigerant leakage detection sensor 60 is positioned in a distance from the refrigerant pipes 58 towards the front.

In particular, the refrigerant leakage detection sensor 60 (more particularly its refrigerant reception area 70) is positioned in a space defined in a first direction (x-axis) by the first side 46 of the heat exchanger 30 and the first side 24 of the housing 10 or more particularly in the present embodiment a side wall of the electric box 56 facing the first side 46 of the heat exchanger 30. The space is defined in a second direction (z-axis) by the front 18 of the housing 10 (see inner or back surface of the front cover 14) and the piping connection section 52. In this context, the smallest envelope covering the piping connecting section 52 limits the space at its back. As a consequence, the refrigerant leakage detection sensor 60 is positioned in a front view of the indoor unit beside the heat exchanger 30 and in front of the piping connection section 52 and a side view of the indoor unit between the front 18 of the housing 10 and the piping connection section 52.

In the present embodiment, the space is even further limited in the second direction (y-axis) by the support structure 74, particularly the first to fifth shield 80, 82, 84, 92 and 96. Thus, if a refrigerant leak occurs in the piping connection section 52, the concentration of leaking refrigerant and the environment of the refrigerant leakage detection sensor 60, particularly its refrigerant reception area 70 can be kept high so as to enhance detection speed and accuracy.

If a refrigerant leak occurs between the opposite sides 46 and 48 of the heat exchanger 30 or at the second side 48 of the heat exchanger 30, the refrigerant may still reach the refrigerant leakage detection sensor 60, more particularly its refrigerant reception area 70, in a sufficiently short time. The refrigerant may in some cases flow along the back surface 44 of the heat exchanger 30 towards the piping connection section 52 entering the space in which the refrigerant leakage detection sensor 60 (the refrigerant reception area 70) is positioned. In another case, the refrigerant may flow along the front surface 42 of the heat exchanger 30 and then through the through holes 98 of the support structure 74 entering the space in which the refrigerant leakage detection sensor 60 (the refrigerant reception area 70) is positioned. Thus, also in this case it quick and accurate detection of a refrigerant leak is enabled.

Even further, the refrigerant leakage detection sensor 60 (refrigerant reception area 70) is positioned closer to the bottom end 14 of the heat exchanger 30 than to a top end 38 of the heat exchanger 30. Particularly if refrigerant having a higher density than air is used, such as R32, the leaking refrigerant tends to accumulate in the lower portion of the housing 10. The above positioning thus allows more reliable and faster detection of such leaking refrigerant. Further, even small leakage may be detected.

Even further, the first shield 80 shields and, therefore protects, the electric cable 65 from water. During operation condensation water may form on the refrigerant pipes 58 in the piping connection section 52. Due to the air flow induced by the fan the condensation water may disassociate from the refrigerant pipes 58. The first shield 80 will catch those water drops and prevent them from reaching the electric cable 65. As a result, water may not flow along the electric cable 65 and, thereby enter the sensor casing 62 via the opening 120. Thus, the lifetime of the refrigerant leakage detection sensor 60 can be enhanced.

The third shield 84 prevents the water drops caught by the first shield 80 from reaching the gas sensor 66, particularly the refrigerant reception area 70. In particular, the refrigerant reception area 70 springs back relative to the free edge 85 of the third shield 84. As the water drops will drop down from the free edge 84 they drop towards the bottom of the housing 10 in a distance from the refrigerant reception area 70.

As a consequence, the first shielding structure 78 has a double function to seal the space in order for increased the refrigerant concentration adjacent the refrigerant leakage detection sensor 60 (refrigerant reception area 70) in case of a refrigerant leak and to protect the refrigerant leakage detection sensor 60 from water drops.

Additionally, the refrigerant detection sensor 60 is as previously mentioned disposed in a distance from the refrigerant pipes 58 of the piping connection section 52. Thus, the refrigerant detection sensor 60 encompasses smaller temperature changes as compared to a refrigerant detection sensor 60 positioned close to or even attached to the refrigerant pipes. Smaller temperature changes also result in less condensation water being formed on the refrigerant detection sensor 60.

In addition, due to the first shielding structure 78 and the second shielding structure 90 the air flow around the refrigerant leakage detection sensor 60, particularly the refrigerant reception area 70 can be reduced. Thus, also the amount of water in the air flowing around the refrigerant leakage detection sensor 60 can be reduced. Hence, that refrigerant leakage detection sensor 60 does not need to be waterproof.

REFERENCE SIGNS LIST

10 housing
12 body
14 front cover
16 back
18 front
20 bottom
22 top
24 first side
26 second side
28 suction area
29 discharge area
30 heat exchanger
32 first front portion
34 second front portion
36 rear portion
38 top end
40 bottom end
42 front surface
44 back surface
46 first side

48 second side
50 U-bend
52 piping connection section
54 rotational axis of fan
56 electric box
58 refrigerant pipe
60 refrigerant leakage detection sensor
62 sensor casing
64 circuit board
65 electric cable
66 gas sensor
68 sensor housing
70 refrigerant reception area
72 opening
74 support structure
76 mounting portion
78 first shielding structure
80 first shield
81 front side
82 second shield
83 side edge
84 third shield
85 slanted edge
86 cable clip
87 lower end
88 free edge
90 second shielding structure
92 fourth shield
94 bottom portion
96 fifth shield
98 through holes
102 casing body
104 lid
106 side wall (front wall)
108 side wall (back wall)
110 top wall
112 bottom wall
114 side wall
116 side walls
118 insulation
120 opening

CITATION LIST

Patent Literature

[PTL 1] WO 2019/138529 A1

The invention claimed is:

1. Indoor unit of a heat pump comprising a refrigerant circuit, wherein the indoor unit comprises:

a housing having a back configured to be mounted on a wall and a front opposite to the back;

a heat exchanger accommodated in the housing;

a piping connection section fluidly connected to the heat exchanger at one side of the heat exchanger and configured to connect the heat exchanger to the refrigerant circuit of the heat pump;

a fan for inducing an air flow through the heat exchanger, wherein heat is to be exchanged between a refrigerant flowing through the heat exchanger and the air flow; and a refrigerant leakage detection sensor for detecting a refrigerant leakage in the indoor unit, the refrigerant leakage detection sensor being accommodated in the housing;

wherein the refrigerant leakage detection sensor is positioned, in a front view of the indoor unit, beside the heat exchanger and in front of the piping connection section and, in a side view of the indoor unit, between the front of the housing and the piping connection section.

2. Indoor unit according to claim 1, wherein the refrigerant leakage detection sensor is positioned closer to a bottom end of the heat exchanger than to a top end of the heat exchanger.

3. Indoor unit according to claim 1, further comprising an electric box accommodated in the housing adjacent the piping connection section of the heat exchanger, wherein refrigerant leakage detection sensor is positioned, in a front view of the indoor unit, between the heat exchanger and the electric box.

4. Indoor unit according to claim 1, wherein the refrigerant leakage detection sensor comprises a sensor casing;

a circuit board enclosed by the sensor casing; and a gas sensor mounted on the circuit board, the gas sensor having a sensor housing, a refrigerant reception area at an end of the sensor housing allowing gaseous refrigerant to enter the sensor housing and a sensing element in the sensor housing, wherein the sensor housing protrudes through an opening in a side wall of the sensor casing in a direction towards the piping connection section so that the refrigerant reception area is arranged on an outside of the sensor casing.

5. Indoor unit according to claim 4, wherein the sensor casing is mounted in the indoor unit via a support structure, the support structure comprising a first shielding structure having a first shield extending upwardly from the side wall of the sensor casing having the opening, and covering, in a front view, refrigerant pipes extending from a side of the heat exchanger.

6. Indoor unit according to claim 5, wherein the refrigerant leakage detection sensor comprises an electric cable connected to the circuit board through an opening in a top wall of the sensor casing, the electric cable extending from the top wall of the sensor casing along a front side of the first shield to an/the electric box accommodated in the housing so that the electric cable is shielded relative to the refrigerant pipes by the first shield.

7. Indoor unit according to claim 5, wherein the first shielding structure has a second shield extending from a side edge of the first shield towards a front surface of the heat exchanger.

8. Indoor unit according to claim 7, wherein the second shield has a slanted edge facing the front surface of the heat exchanger and corresponding to the shape of the front surface of the heat exchanger.

9. Indoor unit according to claim 5, wherein the first shielding structure has a third shield extending from a lower end of the first shield towards the piping connection section and beyond the refrigerant reception area so that the end of the third shield facing the piping connection section is located closer to the piping connection section than the refrigerant reception area.

10. Indoor unit according to claim 5, wherein the support structure has a second shielding structure having a fourth shield extending downwardly from the side wall of the sensor casing having the opening.

11. Indoor unit according to claim 10, wherein the fourth shield has a bottom portion slanted towards the pipe connection section and corresponding in a side view to the shape of the front surface of the heat exchanger.

12. Indoor unit according to claim 10, wherein the support structure has a fifth shield extending from the fourth shield towards the piping connection section.

13. Indoor unit according to claim 5, wherein the support structure has at least one through hole for allowing gaseous refrigerant to pass from a side of the support structure facing the front of the indoor unit through the support structure and to the refrigerant reception area of the refrigerant leakage detection sensor.

14. Indoor unit according to claim 4, wherein the circuit board comprises an evaluation unit configured to evaluate a signal received from sensing element, to conclude on refrigerant leakage based on the received signal and to output a leakage signal to a controller of the indoor unit.

15. Indoor unit according to claim 1, wherein the housing comprises a body at least including the back and a front cover at least including the front, the front cover being removable, and the refrigerant leakage detection sensor is accessible upon removal of the front cover.

16. Indoor unit according to claim 2, further comprising an electric box accommodated in the housing adjacent the piping connection section of the heat exchanger, wherein refrigerant leakage detection sensor is positioned, in a front view of the indoor unit, between the heat exchanger and the electric box.

17. Indoor unit according to claim 2, wherein the refrigerant leakage detection sensor comprises a sensor casing;

a circuit board enclosed by the sensor casing; and a gas sensor mounted on the circuit board, the gas sensor having a sensor housing, a refrigerant reception area at an end of the sensor housing allowing gaseous refrigerant to enter the sensor housing and a sensing element in the sensor housing, wherein the sensor housing protrudes through an opening in a side wall of the sensor casing in a direction towards the piping connection section so that the refrigerant reception area is arranged on an outside of the sensor casing.

18. Indoor unit according to claim 3, wherein the refrigerant leakage detection sensor comprises a sensor casing;

a circuit board enclosed by the sensor casing; and a gas sensor mounted on the circuit board, the gas sensor having a sensor housing, a refrigerant reception area at an end of the sensor housing allowing gaseous refrigerant to enter the sensor housing and a sensing element in the sensor housing, wherein the sensor housing protrudes through an opening in a side wall of the sensor casing in a direction towards the piping connection section so that the refrigerant reception area is arranged on an outside of the sensor casing.

19. Indoor unit according to claim 6, wherein the first shielding structure has a second shield extending from a side edge of the first shield towards a front surface of the heat exchanger.

20. Indoor unit according to claim 6, wherein the first shielding structure has a third shield extending from a lower end of the first shield towards the piping connection section and beyond the refrigerant reception area so that the end of the third shield facing the piping connection section is located closer to the piping connection section than the refrigerant reception area.

* * * * *